US011807428B2

(12) United States Patent
Sharon

(10) Patent No.: US 11,807,428 B2
(45) **Date of Patent: *Nov. 7, 2023**

(54) CONTAINER WITH KNOCKOUT-STACKABLE GABLE WITH TOP TAB

(71) Applicant: Menasha Corporation, Neenah, WI (US)

(72) Inventor: Arie Sharon, Garland, TX (US)

(73) Assignee: Menasha Corporation, Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/702,441

(22) Filed: Mar. 23, 2022

(65) Prior Publication Data

US 2022/0258905 A1 Aug. 18, 2022

Related U.S. Application Data

(63) Continuation of application No. 16/506,472, filed on Jul. 9, 2019, now Pat. No. 11,312,525.

(60) Provisional application No. 62/695,917, filed on Jul. 10, 2018.

(51) Int. Cl.

| | |
|---|---|
| ***B65D 5/06*** | (2006.01) |
| ***B65D 5/00*** | (2006.01) |
| ***B65D 5/42*** | (2006.01) |
| *A47F 5/10* | (2006.01) |

(52) U.S. Cl.

CPC ..... *B65D 5/0015* (2013.01); *B65D 5/067* (2013.01); *B65D 5/4204* (2013.01); *A47F 5/108* (2013.01)

(58) Field of Classification Search

CPC ..... A47F 5/108; B65D 5/0015; B65D 5/067; B65D 5/001; B65D 5/4204; B65D 5/18; B65D 5/42

USPC ..... 220/4.26; 206/507, 509, 112; 229/915, 229/915.1, 108, 249

See application file for complete search history.

(56) References Cited

U.S. PATENT DOCUMENTS

| | | | | |
|---|---|---|---|---|
| 1,950,104 | A * | 3/1934 | Ewers | B65D 5/067 229/101 |
| 2,777,597 | A * | 1/1957 | Ruff | B25H 3/02 206/509 |
| 4,899,929 | A | 2/1990 | Grollman | |
| 5,520,284 | A | 5/1996 | Gray | |
| D399,739 | S | 10/1998 | Sheffer | |
| D399,740 | S | 10/1998 | Sheffer | |
| D399,741 | S | 10/1998 | Sheffer | |
| 9,090,037 | B2 | 7/2015 | Swenson | |
| 9,452,874 | B2 | 9/2016 | Harrelson | |
| 9,566,756 | B2 | 2/2017 | Brundage | |
| 9,580,201 | B2 | 2/2017 | Willman et al. | |
| 9,783,334 | B2 | 10/2017 | McLeod et al. | |
| 9,919,829 | B2 | 3/2018 | Jolley | |
| 10,093,446 | B2 | 10/2018 | Brundage | |
| 10,239,650 | B2 | 3/2019 | Jacomelli et al. | |

(Continued)

*Primary Examiner* — John K Fristoe, Jr.
*Assistant Examiner* — Elizabeth J Volz
(74) *Attorney, Agent, or Firm* — GREENSFELDER, HEMKER & GALE, P.C.; Richard C. Himelhoch

(57) ABSTRACT

The invention is directed to a stackable container having a gable type top wall and a gable type bottom wall. The top wall of the container can include an upwardly extending tab that cooperates with a slot in the bottom wall of a like container to facilitate stacking of two or more containers. The container includes a front opening.

20 Claims, 10 Drawing Sheets

(56) References Cited

U.S. PATENT DOCUMENTS

| | | | | |
|---|---|---|---|---|
| 10,407,207 | B2 | 9/2019 | Keefe, Jr. | |
| 10,526,107 | B2 | 1/2020 | Couture | |
| D949,685 | S | 4/2022 | Box | |
| 11,312,525 | B2 * | 4/2022 | Sharon | B65D 5/0015 |
| 11,312,527 | B2 | 4/2022 | Smith et al. | |
| 11,325,741 | B1 | 5/2022 | Philips et al. | |
| 11,325,743 | B2 | 5/2022 | Simpkins et al. | |
| 2003/0141356 | A1 | 7/2003 | Sheffer | |
| 2003/0146126 | A1 | 8/2003 | Kanter et al. | |
| 2010/0252620 | A1 * | 10/2010 | Gayoso | B65D 5/067 229/249 |
| 2015/0191272 | A1 | 7/2015 | McLeod et al. | |
| 2016/0009439 | A1 | 1/2016 | Armstrong et al. | |
| 2017/0152072 | A1 | 6/2017 | Brundage | |
| 2019/0009946 | A1 | 1/2019 | Nixon et al. | |
| 2019/0030849 | A1 | 1/2019 | Aganovic et al. | |
| 2019/0256241 | A1 | 8/2019 | Exner et al. | |
| 2020/0017253 | A1 | 1/2020 | Sharon | |
| 2022/0127038 | A1 | 4/2022 | McCarthy | |

* cited by examiner

CONTAINER WITH KNOCKOUT-STACKABLE GABLE WITH TOP TAB

CROSS-REFERENCE TO RELATED APPLICATIONS

The present application is a continuation of U.S. patent application Ser. No. 16/506,472 filed Jul. 9, 2019, which claims priority to and the benefit of U.S. Provisional Patent Application No. 62/695,917 filed Jul. 10, 2018, the contents of which are incorporated herein by reference.

FEDERALLY SPONSORED RESEARCH OR DEVELOPMENT

N/A

FIELD OF THE INVENTION

The present invention is generally related to a stackable container having a gable type top portion and a gable type bottom portion, the top portion can have a tab which can cooperate with a slot in a bottom portion of a like container for stable stacking of such containers.

DESCRIPTION OF THE PRIOR ART

A large variety of containers are used to display goods at a retail location. The containers must be functional and attract attention of the retail shopper. Often the containers are stacked up each other to create a larger display of goods.

The present invention provides an attractive container having that can be securely stacked upon other identical or substantially similar containers.

SUMMARY OF THE INVENTION

The present invention includes a generally rectangular container with a gable top side or portion and a gable bottom side or portion. The dimensions of the top side gable are configured to match the dimensions of the bottom side gable. The top center of the bottom side of the container can include a slot that runs horizontally. The top side can include a tab that extends upward. The tab of the top side is designed to fit into the slot on the bottom side of a like container (as used herein, a "like" container refers to either an identical container and one that is substantially similar which shares sufficient features or structure with the container at issue to enable it to stack with such container). This allows for more stable stacking of multiple like containers. While a single, centrally located slot/tab combination is described above—the containers can include off-center and/or multiple tabs/slots. Additionally, the tab/slots can be reversed (i.e., tab extending downward from the bottom side to cooperate with a slot in the top side) or mixed with each side including tabs and slots positioned to cooperate with tabs and slots of the other side. The tab(s) and slot(s) prevent an upper container from sliding off a lower container when stacked on each other.

The container can be formed from a single blank of material. The blank can be die cut and include fold or score lines. Glue can be used as appropriate to connect portions of the container. The material can be corrugated paper or corrugated plastic, paperboard or any other suitable material.

In accordance with one aspect of the invention, a stackable container with a gable top portion and bottom portion is provided. The container comprises a rectangular back wall having a horizontal top edge having a first end and a second end. The back wall also includes a horizontal bottom edge having a first end and a second end. The container further comprises a front wall having a horizontal top edge having a first end and a second end, and a horizontal bottom edge having a first end and a second end. The container includes a first side wall extending between the back wall and the front wall. The first side wall has a first top edge segment extending upward from the first end of the top edge of the back wall to a central top side wall location and a second top edge segment extending upward from the first end of the top edge of the front wall to the central top side wall location. The first side wall further includes a first bottom edge segment extending upward from the first end of the bottom edge of the back wall to a central bottom side wall location and a second bottom edge segment extending upward from the first end of the bottom edge of the front wall to the central bottom side wall location.

Similar to the first side wall, the container includes a second side wall extending between the back wall and the front wall. The second side wall includes a first top edge segment extending upward from the second end of the top edge of the back wall to a central top side wall location and a second top edge segment extending upward from the second end of the top edge of the front wall to the central top side wall location. Additionally, the second side wall includes a first bottom edge segment extending upward from the second end of the bottom edge of the back wall to a central bottom side wall location and a second bottom edge segment extending upward from the second end of the bottom edge of the front wall to the central bottom side wall location. The top and bottom segments of the first and second side walls can have an upside down "V" shape or profile.

The container further includes a top wall formed from a top flap extending from the top edge of the back wall. The top flap has side edges aligning with first top edge segment of the first side wall and the first top edge of the second side wall. Additionally, the top wall includes a top flap extending from the top edge of the front wall. This top flap has side edges aligning with the second top edge segment of the first side wall and the second top edge segment of the second side wall.

The container also includes a bottom wall formed from a bottom flap extending from the bottom edge of the back wall. The bottom flap has side edges aligning with first bottom edge segment of the first side wall and the first bottom edge segment of the second side wall. The bottom wall also includes a bottom flap extending from the bottom edge of the front wall. This bottom flap has side edges aligning with the second bottom edge segment of the first side wall and the second bottom edge segment of the second side wall.

The container can further comprise an opening in the front wall. Additionally, the container can also include an opening in the top wall contiguous with the opening in the front wall.

The container can further include a first tab extending upward from the top wall. The tab can be centrally located, i.e., midway between the side walls at the highest location of the top wall. In other aspects of the invention, the container can include more than one tabs extending upward from the top wall, positioned at various locations.

The container can also include a first slot in the bottom wall aligned with the first tab of the top wall. The slot is designed to cooperate with the tab of a like container to enable the containers to stably stack together. In other aspects of the invention, the bottom wall can include other slots designed to cooperate with other tabs if present.

The container can further comprise a top flap extending upward from the first top edge segment of the first side wall and a top flap extending upward from the second top edge segment of the first side wall. Similarly, the container can comprise a top flap extending upward from the first top edge segment of the second side wall and a top flap extending upward from the second top edge segment of the second side wall.

The container can also further comprise a bottom flap extending downward from the first bottom edge segment of the first side wall and a bottom flap extending downward from the second bottom edge segment of the first side wall. Similarly, the container can comprise a bottom flap extending downward from the first bottom edge segment of the second side wall and a bottom flap extending downward from the second bottom edge segment of the second side wall.

The container can be formed from a single blank of material wherein each of the walls and flaps are integrally connected and are separated by fold lines. The container can be formed from paperboard or plastic, or a corrugated paper or plastic sheet. Other suitable materials may also be used.

The container can include one or more glue panels. One such glue panel can be connected to the second side wall and can be glued to a side edge portion of the back wall.

The container can comprise a detachable panel in the front wall. Detachment of the detachable panel forms an opening in the front wall. The detachable panel can also extend into a portion of the top wall.

The container can also include a locking flap extending from a top edge of the top flap of the back wall and a locking flap extending from a top edge of the top flap of the front wall. The locking flap extending from one or both of the top flaps of the back wall can include an upwardly positioned tab when folded.

The bottom flaps from the back wall and the front wall can include a plurality of locking tabs. The tabs are in a zigzag pattern with corresponding zigzagging resting areas. The zigzag tabs and the zigzag resting areas are overlapping each other, and cooperate to trap the bottom flaps in a locked position. With the flaps locked, the container can be loaded with product without the bottom caving in.

Further aspects of the invention are disclosed in the description and claims, and are shown in the Figures.

BRIEF DESCRIPTION OF THE DRAWINGS AND ATTACHMENTS

To understand the present invention, it will now be described by way of example, with reference to the accompanying drawings and attachments in which.

DETAILED DESCRIPTION

Figure 1:
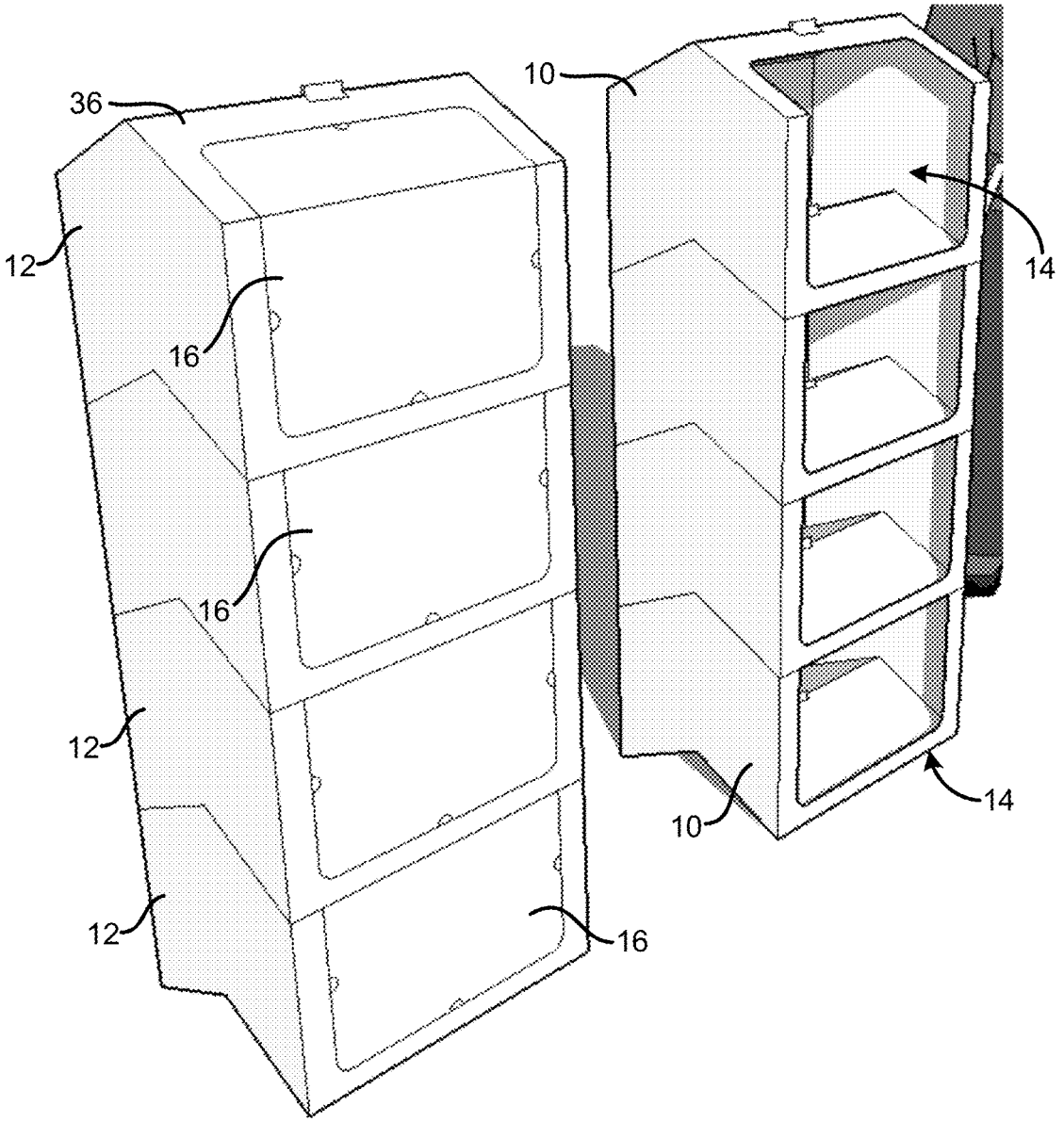
FIG. 1 is a perspective view of a stack of closed container positioned next to a stack of open containers made in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a first stack of containers 10 in accordance with one aspect of the present invention, and a second stack of containers 12 in accordance with a modified aspect of the present invention. The containers 10 of the first stack are shown having an opening or window 14 in a front and a top portion of the container 10. The containers 12 of the second stack are shown having a detachable panel 16 in the front and top portions of the container 12. Upon removal of the detachable panel 16, the containers 12 of the second stack will appear similar or identical to the containers 10 of the first stack.

As used herein, directional or positional terms (e.g., front, top, horizontal, etc.) are made with respect to the invention as shown and positioned in the drawings, and as typically set up. These terms are not meant to limit the invention to being in such positions (e.g., a "top" wall or portion described herein would still be a "top" wall even if one placed a container upside down).

Figure 2A:
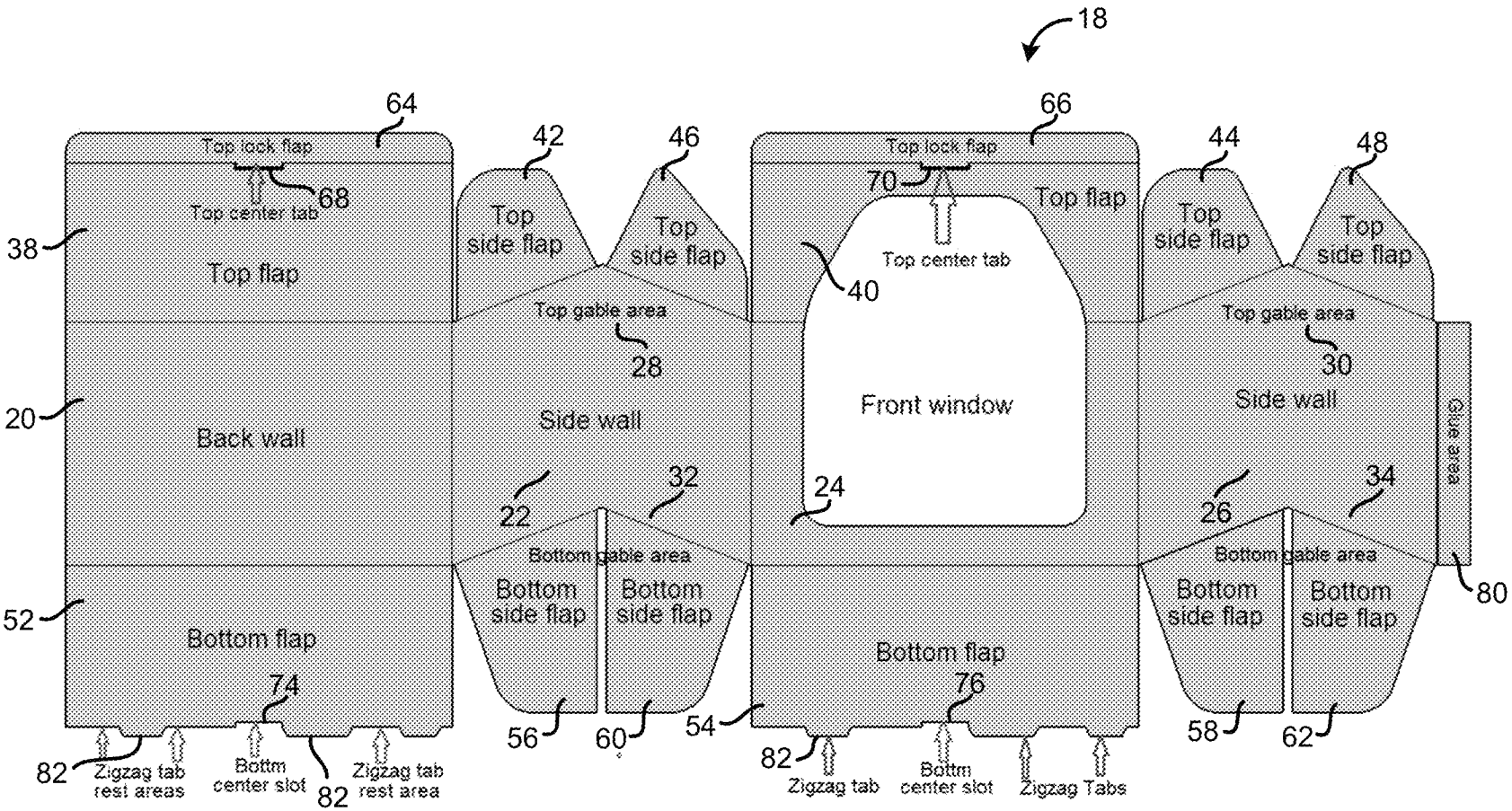
FIG. 2A is a top plan view of a blank for forming an open container in accordance with the present invention with components of the blank labeled
Figure 2B:
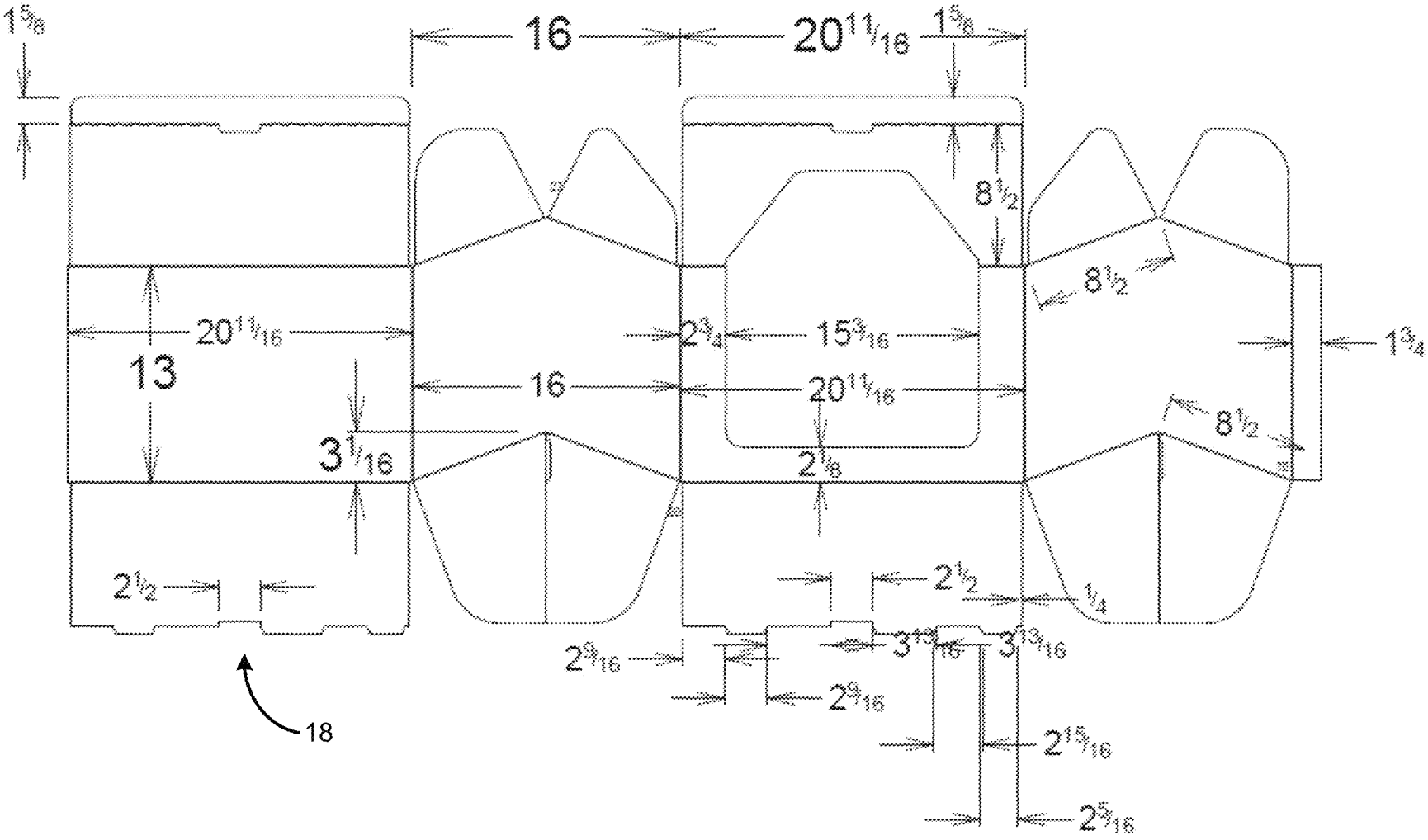
FIG. 2B is a top plan view of a blank for forming an open container in accordance with the present invention illustrating preferred dimensions.

FIGS. 2A and 2B illustrate a blank 18 for forming the containers 10 shown in the first stack of FIG. 1. The blank 18 is cut from a sheet of material, such as paperboard, a plastic sheet, or a corrugated paper or corrugated plastic sheet (or other similar or suitable material).

The blank 18 includes panels for a back wall 20, a first side wall 22, a front wall 24 and a second side wall 26. The panels are separated by fold lines.

Each of the first and second side walls 22, 26 have matching top gable areas 28, 30, respectively. The gabled areas 28, 30 are formed from angled segments forming an upwardly directed point at a central location (e.g., an upside down "V" shape). Each side wall includes a first top edge segment that extends upward from one end of a top edge of the back wall and a second top edge segment that extends upward from one end of the top edge of the front wall. The segments meet at the central location to form the upside down "V" shape.

Similarly, each of the first and second side walls 22, 26 include bottom gable areas 32, 34, respectively, having angled segments forming an upwardly directed point at a central location that match or mirror the top gable areas 28, 30. Each side wall includes a first bottom edge segment extending upward from one side of a bottom edge of the back wall, and second bottom edge segment extending upward from one end of a bottom edge of the front wall. This matching shape (between the top of the side walls and the bottom of the side walls) facilitates stacking two or more like containers.

A top wall or side 36 is formed from a plurality of flaps extending upward from the back, first side, second side and front walls 20, 22, 24 and 26. These include a top flap 38 extending from the top edge of the back wall 20 and a corresponding top flap 40 extending from the top edge of the front wall 24. Each of the side walls 22, 26 include a first top flap 42, 44 (spanning one of the angled segments forming an upper edge of the gable area) and a second top flap 46, 48 (spanning another of the angled segments forming the upper edge of the gable area). The flaps extending from the side walls 22, 26 are folded under the flaps 38, 40 extending from the back and front walls 20, 24 when the container 10 is set up.

Similar to the top side 36, a bottom wall or side 50 is formed from a plurality of flaps extending upward from the back, first side, second side and front walls 20, 22, 24 and 26. These include a bottom flap 52 extending from the bottom edge of the back wall 20 and a corresponding bottom flap 52 extending from the bottom edge of the front wall 24. Each of the side walls 22, 26 include a first bottom flap 56, 58 (spanning one of the angled segments forming a lower edge of the gable area) and a second bottom flap 60, 62 (spanning another of the angled segments forming the lower edge of the gable area). The flaps extending from the side walls 22, 26 are folded under the flaps 52, 54 extending from the back and front walls 20, 24 when the container 10 is set up. The bottom and top edges of the back wall 20 and the front wall 24 are generally horizontal when set up.

The top flap 38 from the back wall 20 and the top flap 40 from the front wall 24 each include a locking flap 64, 66, that when folded, force tabs 68, 70 to extend upward from the container 10 when set up. The tabs 68, 70 are aligned and effectively form a single tab structure 72 (while each flap 64, 66 includes a tab 68, 70, in the example illustrated, a container can also be formed wherein only one of the top flaps 38, 40 includes structure for forming a tab).

The bottom flap 52 from the back wall 20 and the bottom flap 54 from the front wall 24 each include a centrally located cut away portion 74, 76 that collectively form a slot 78 when the container 10 is set up. The slot 78 cooperates with the tab 72 of a like container 10 when stacking two or more like containers 10.

FIGS. 2A and 2B also show the front window 16 which extends through a portion of the front wall 24 and a portion of the top flap 40 extending from the front wall 24. Other windows can be provided on the back wall and side walls as desired.

Additionally, the blank 18 includes a glue panel 80 extending at one end of the blank 18 from the side of the second side wall 26. The glue panel 80 is glued to the edge of the back wall 20 at the other end of the blank 18 to initially begin forming the container 10.

Figure 3:
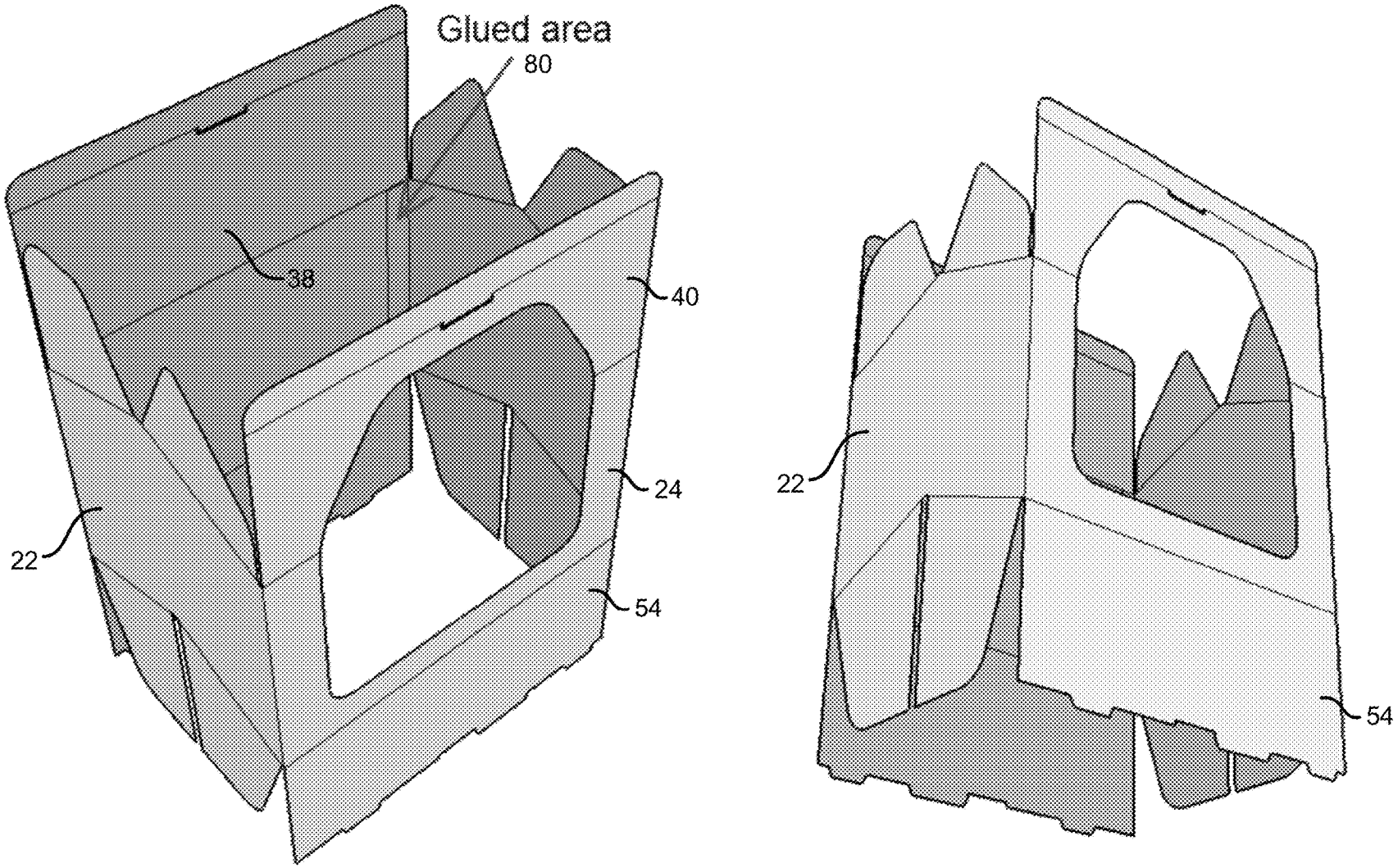
FIGS. 3-8 are perspective views of two blanks of FIGS. 2A and 2B progressively being formed into containers in accordance with the present invention; and, FIG. 9 is a perspective view of a stack of open containers in accordance with the present invention next to an exploded view of a stack of open containers.
Figure 4:
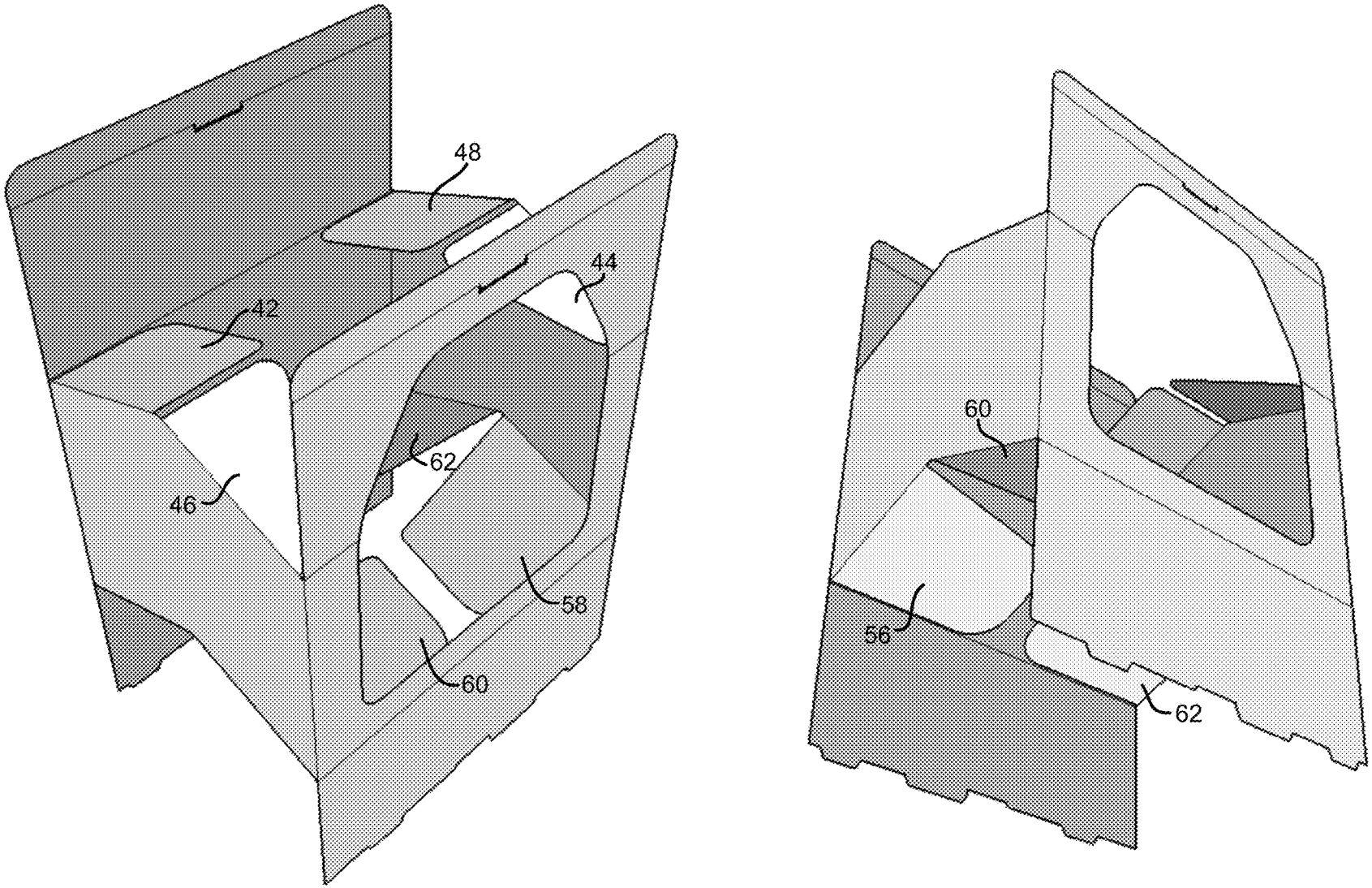
Figure 5:
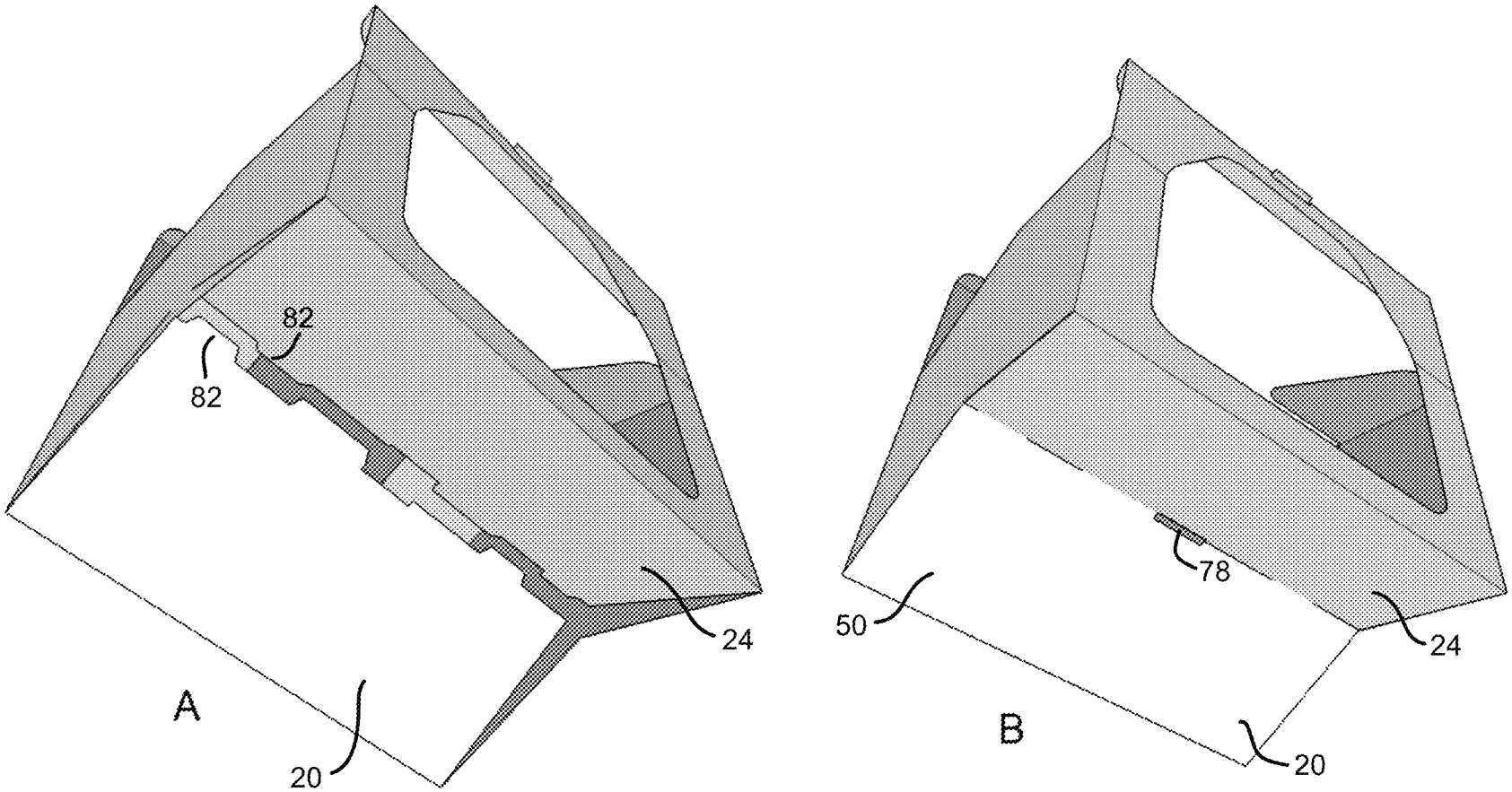

FIGS. 3-8 illustrate formation of the container 10 from the blank 18. As shown in FIG. 3, the glue panel 80 is glued to an inwardly facing surface of the back wall 20 to create a rectangular tube like shape having an open top and open bottom. FIG. 4 illustrates the top flaps 42, 44, 46, 48 and bottom flaps 56, 58, 60, 62 of the first and second side walls 22, 26 initially folded inward. This is followed in FIG. 5 with the bottom flaps 52, 54 of the back and front walls 20, 24 folded inward. The slot 78 is formed when the flaps 52, 54 are locked together. The bottom flaps 52, 54 include various tabs 82, in a zigzag pattern with intervening resting areas, extending from a bottom edge of the flaps to lock the flaps 52, 54 together.

Figure 6:
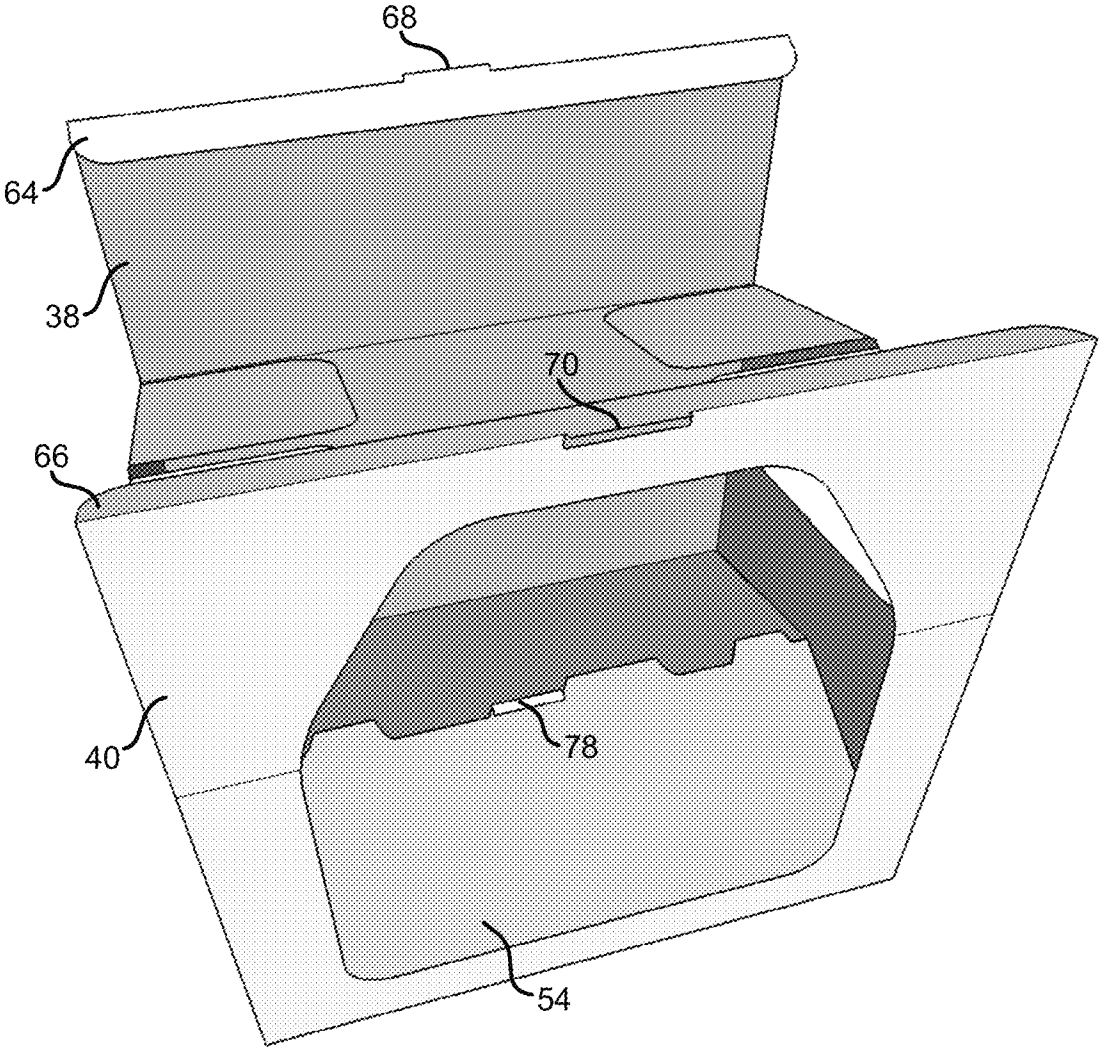
Figure 7:
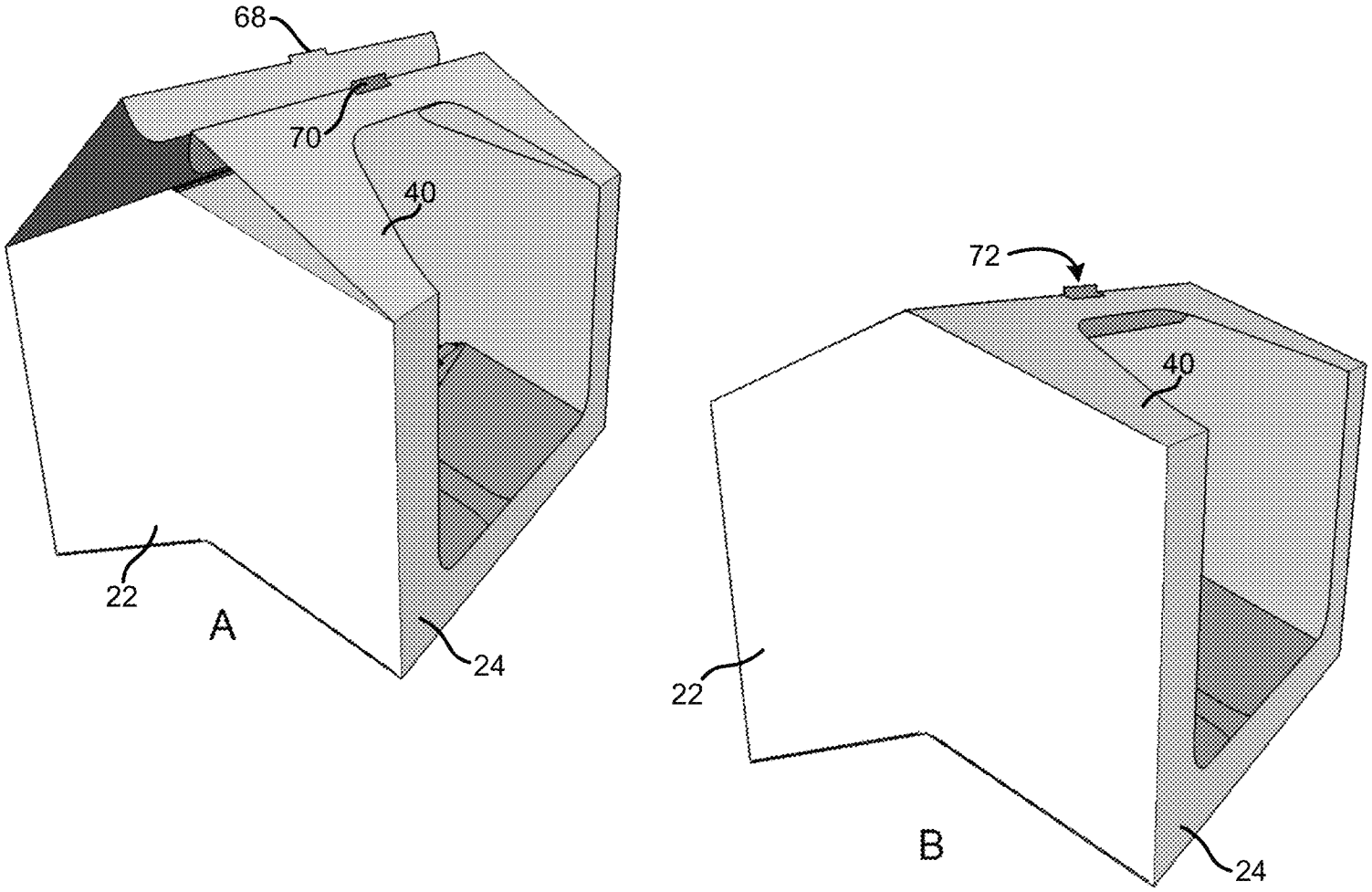
Figure 8:
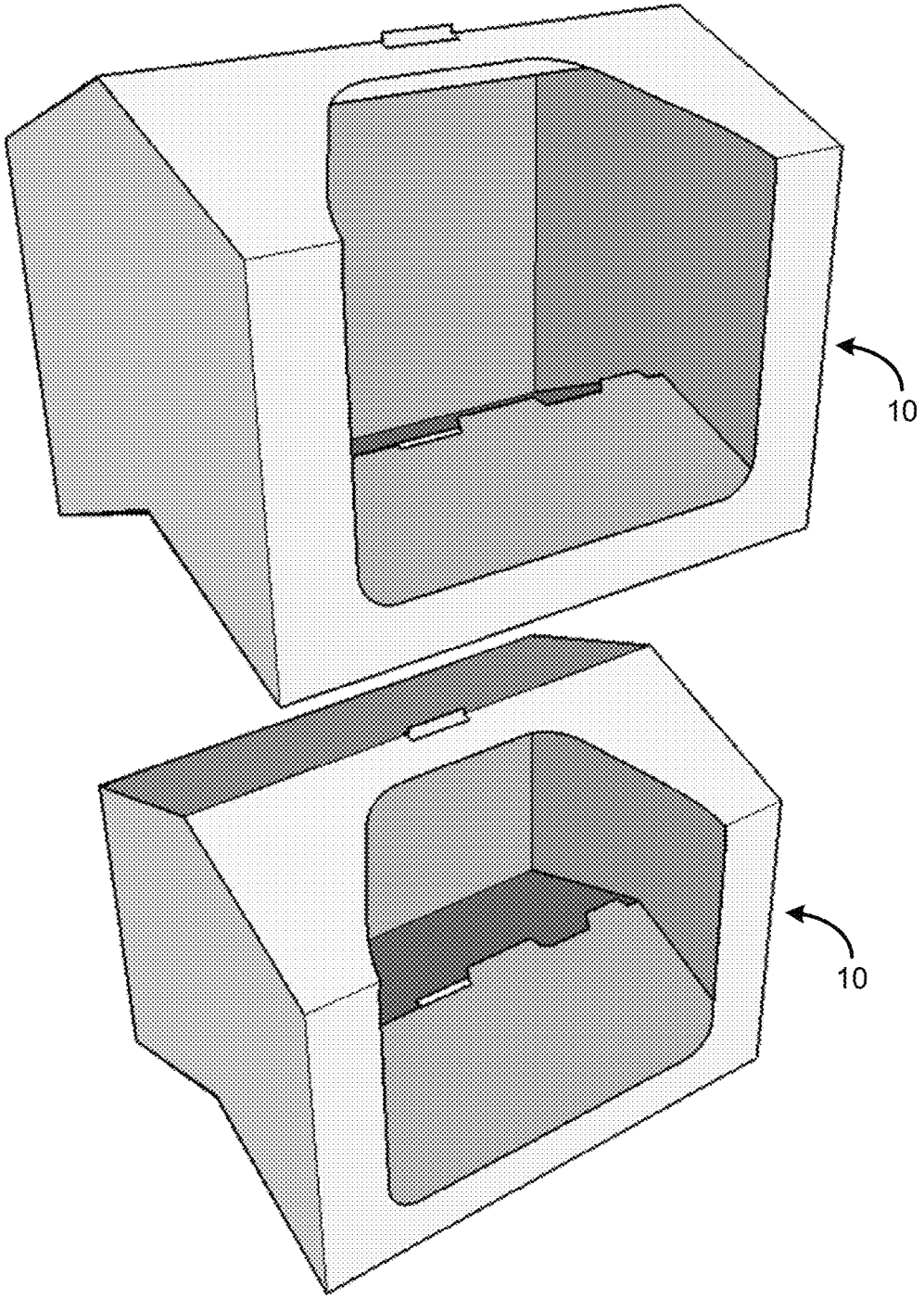

FIG. 6 shows the locking flaps 64, 66 connected to the top flaps 38, 40 folded downward. This forces tabs 68, 70 to extend upward. FIG. 7 shows the top flaps 38, 40 folded downward to form the top side of the container 10 with the upwardly extending tab 72 (formed from the tabs 68, 70). Two set up containers 10 are shown in FIG. 8.

Figure 9:
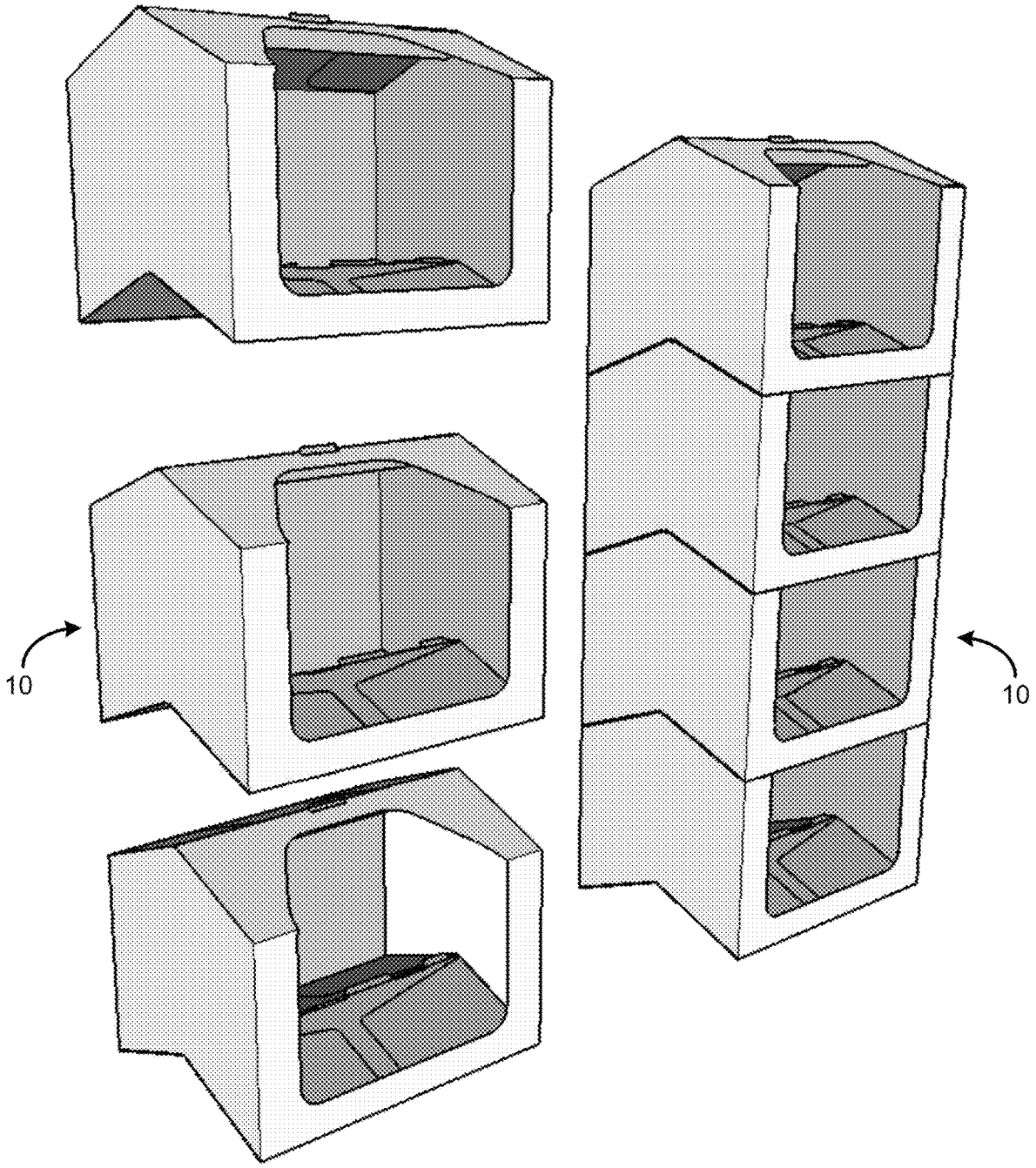

FIG. 9 shows four set up containers 10 stacked together on the right and three aligned containers 10 in an exploded view.

Many modifications and variations of the present invention are possible in light of the above teachings. It is, therefore, to be understood within the scope of the appended claims the invention may be protected otherwise than as specifically described.

I claim:

1. A stackable container comprising:

a back wall;

a front wall;

a first side wall having a top gable formed from a first angled segment and a second angled segment forming an upwardly directed point, wherein the first side wall includes a bottom gable formed from a first angled segment and a second angled segment forming an upwardly directed point;

a second side wall having a top gable formed from a first angled segment and a second angled segment forming an upwardly directed point aligned with the upwardly directed point of the first side wall; and, a first bottom wall portion extending at an upward angle from a bottom edge of the back wall and a second bottom wall portion extending at an upward angle from a bottom edge of the front wall.

2. The stackable container of claim 1 wherein the second side wall includes a bottom gable formed from a first angled segment and a second angled segment forming an upwardly directed point.

3. The stackable container of claim 2 further comprising a top flap having an upwardly extending tab.

4. The stackable container of claim 3 wherein the top flap includes a locking flap that forces the tab to extend upwardly.

5. The stackable container of claim 1 wherein the front wall comprises a detachable panel.

6. The stackable container of claim 3 wherein the bottom flap having a slot for receiving an upwardly extending tab of a like container.

7. The stackable container of claim 6 wherein the top flap comprising a first top flap portion connected to a top edge of the back wall and a second top flap portion connected to a top edge of the front wall.

8. The stackable container of claim 7 wherein the bottom flap comprising a first bottom flap portion connected to a lower edge of the back wall and a second bottom flap portion connected to a lower edge of the front wall.

9. The stackable container of claim 8 wherein the container is formed from a single blank of material.

10. The stackable container of claim 9 wherein the container is formed from a corrugated paper.

11. The stackable container of claim 9 wherein the container is formed from paperboard.

12. The stackable container of claim 9 wherein the container is formed from plastic.

13. A stackable container comprising:

a back wall;

a front wall;

a first side wall extending between the back wall and the front wall;

a second side wall extending between the back wall and the front wall;

a first top flap connected to a top edge of the back wall and a second top flap connected to a top edge of the front wall wherein one of the first top flap and the second top flap includes a first top tab extending upward above a top wall formed from the first top flap and the second top flap, wherein one of the first top flap and the second top flap includes a tab lock flap for forcing the first tab into an upwardly extending position.

14. The stackable container of claim 13 wherein another one of the first top flap and the second top flap includes a second top tab extending upward above a top wall formed from the first top flap and the second top flap.

15. The stackable container of claim 13 wherein the first side wall includes a top gable area formed from a first angled segment and a second angled segment meeting at a point with the first angled segment, and the second side wall includes a top gable area formed from a first angled segment and a second angled segment meeting at a point with the first angled segment.

16. The stackable container of claim 15 wherein the first side wall includes a bottom gable area formed from a first angled segment and a second angled segment meeting at a point with the first angled segment, and the second side wall includes a bottom gable area formed from a first angled segment and a second angled segment meeting at a point with the first angled segment.

17. The stackable container of claim 13 further comprising a first bottom flap connected to a bottom edge of the back wall and a second bottom flap connected to a bottom edge of the front wall, the first bottom flap and the second bottom flap forming a bottom wall having a slot for receiving a top tab from a like container.

18. The stackable container of claim 13 wherein the front wall includes a detachable panel.

19. A stackable container comprising:

a back wall;

a front wall having a detachable panel;

a first side wall having a top gable formed from a first angled segment and a second angled segment forming an upwardly directed point;

a second side wall having a top gable formed from a first angled segment and a second angled segment forming an upwardly directed point aligned with the upwardly directed point of the first side wall; and, a first bottom wall portion extending at an upward angle from a bottom edge of the back wall and a second bottom wall portion extending at an upward angle from a bottom edge of the front wall.

20. A stackable container comprising:

a back wall;

a front wall having a detachable panel;

a first side wall extending between the back wall and the front wall;

a second side wall extending between the back wall and the front wall;

a first top flap connected to a top edge of the back wall and a second top flap connected to a top edge of the front wall wherein one of the first top flap and the second top flap includes a first top tab extending upward above a top wall formed from the first top flap and the second top flap.

* * * * *